United States Patent [19]

Danise

[11] Patent Number: 5,042,454

[45] Date of Patent: Aug. 27, 1991

[54] INTERNAL ASHPAN EMPTYING DUST REDUCER AND STORAGE UNIT

[76] Inventor: John Danise, RD #2, Box 53A, Ski Run Rd., Bloomingburg, N.Y. 12721

[21] Appl. No.: 543,867

[22] Filed: Jun. 27, 1990

[51] Int. Cl.[5] ..... F23J 1/00

[52] U.S. Cl. ..... 126/242; 126/243

[58] Field of Search ..... 126/242-245, 126/554, 555; 110/165 R, 165 A, 167, 169, 170

[56] References Cited

U.S. PATENT DOCUMENTS

| | | | |
|---|---|---|---|
| 1,095,276 | 5/1914 | Gnoth | 126/242 |
| 1,624,909 | 4/1927 | Bowman | 126/242 |

FOREIGN PATENT DOCUMENTS

| | | | |
|---|---|---|---|
| 727242 | 6/1932 | France | 126/242 |
| 46005 | 12/1927 | Norway | 126/243 |

*Primary Examiner*—James C. Yeung

*Attorney, Agent, or Firm*—Michael I. Kroll

[57] ABSTRACT

An internal ashpan emptying dust reducer and storage unit is provided and consists of a swivel tray having a handle. The swivel tray holds an ashpan therein and pivotly fits into a front top entrance of a cabinet with the handle extending therefrom so that a door on the front top entrance can close. A storage drawer slides into the bottom of the cabinet to catch coal ash and dust dumped out of the ashpan when the handle is rotated to flip over the swivel tray within the front top entrance.

5 Claims, 2 Drawing Sheets

10
12
14
16
18
20
22
24
26
28
30
31
32
34
36
38
40
42
43
44
46
48
50
52

INTERNAL ASHPAN EMPTYING DUST REDUCER AND STORAGE UNIT

BACKGROUND OF THE INVENTION

1. Field of the Invention

The instant invention relates generally to coal stove ashpans and more specifically it relates to an internal ashpan emptying dust reducer and storage unit.

2. Description of the Prior Art

Numerous coal stove ashpans have been provided in prior art that are adapted to be located underneath the grate systems of coal stoves so that hot coals and hot coal ash will fall into the ashpans which must then be removed therefrom and emptied when full causing the ash dust to cling to everything as the coal ash is being dumped. While these units may be suitable for the particular purpose to which they address, they would not be as suitable for the purposes of the present invention as heretofore described.

SUMMARY OF THE INVENTION

A primary object of the present invention is to provide an internal ashpan emptying dust reducer and storage unit that will overcome the shortcomings of the prior art devices.

Another object is to provide an internal ashpan emptying dust reducer and storage unit that includes a universal swivel tray holding an ashpan which will flip over to drop the coal ash into a storage drawer below to reduce the spread of ash dust therefrom.

An additional object is to provide an internal ashpan emptying dust reducer and storage unit in which the universal swivel tray is adjustable to accommodate different sized ashpans from different types of coal stoves.

A further object is to provide an internal ashpan emptying dust reducer and storage unit that is simple and easy to use.

A still further object is to provide an internal ashpan emptying dust reducer and storage unit that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 3A:
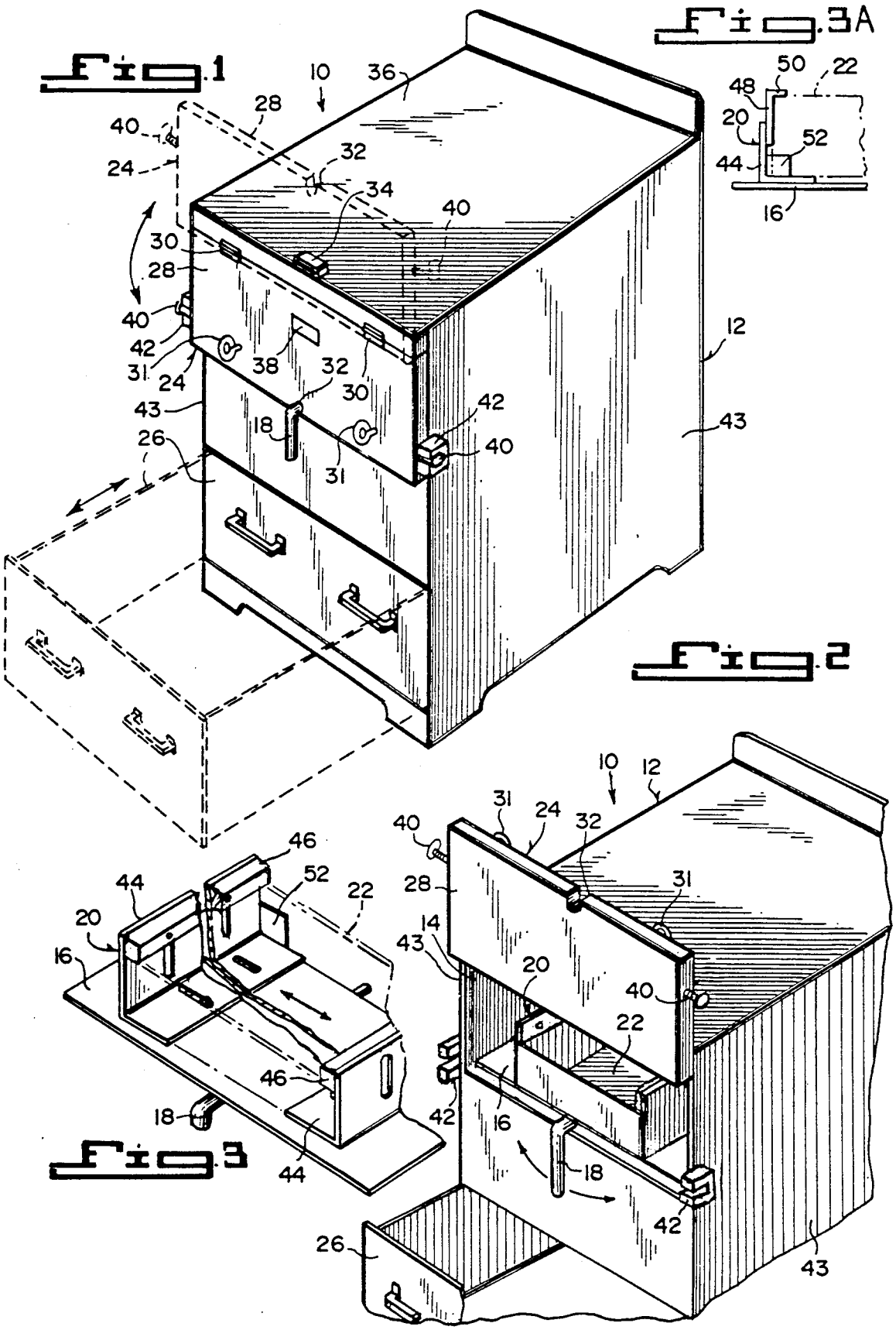
FIG. 1 is a front perspective view of the invention.
FIG. 2 is a front perspective view of the invention with parts broken away showing the door open and the storage drawer pulled out.
FIG. 3 is a front perspective view of the swivel tray with parts broken away.
FIG. 3A is a front view of a portion of the swivel tray showing one of the side brackets and extension brackets holding the ashpan thereto.
Figure 4:
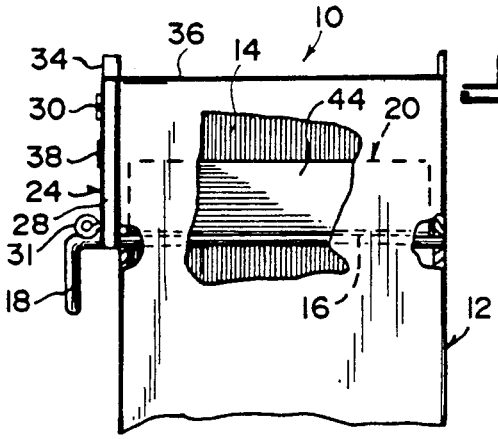
FIG. 4 is a side view of the invention with parts broken away showing the door closed.
Figure 5:
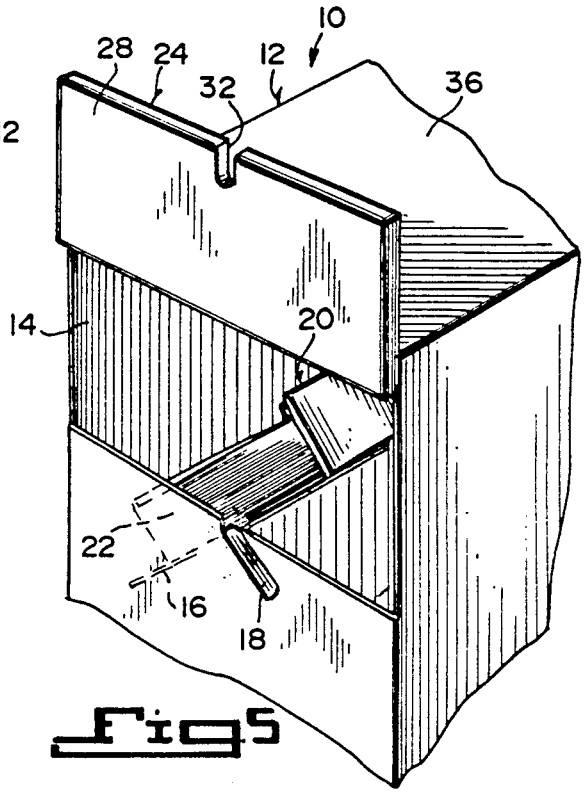
FIG. 5 is a front perspective view of the invention with parts broken away showing the door opened and the swivel tray partly turned.
Figure 6:
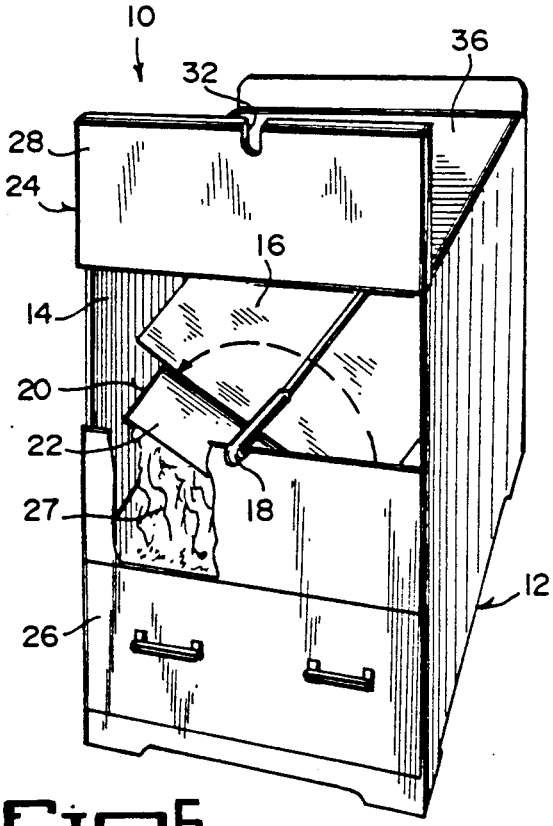
FIG. 6 is a front perspective view of the invention with parts broken away, showing the door open for clarity for it is normally closed, and the swivel tray turned over, dropping the coal ash into the storage drawer.
Figure 7:
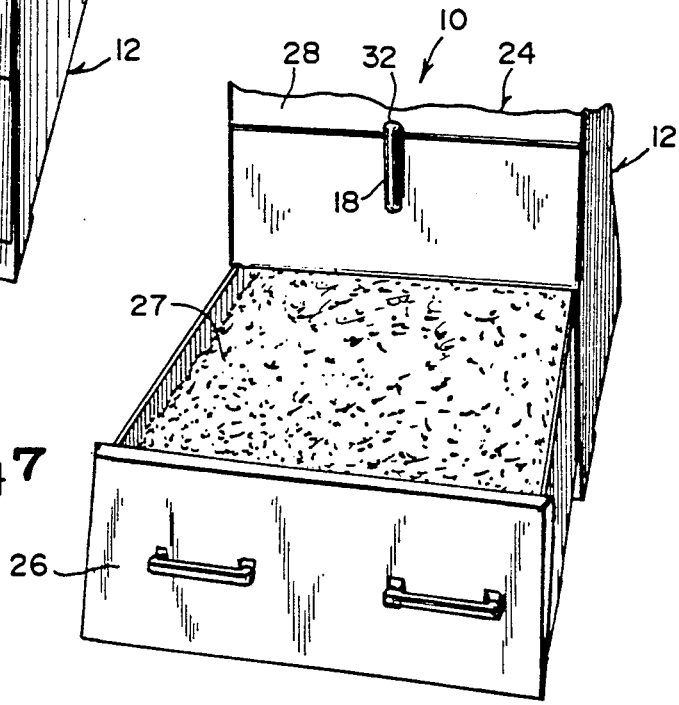
FIG. 7 is a front perspective view of the invention with parts broken away showing the storage drawer pulled out and the coal ash therein.

Turning now descriptively to the drawings, in which similar reference characters denote similar elements throughout the several views, the Figures illustrate an internal ashpan emptying dust reducer and storage unit 10 consisting of a heat resistant metal cabinet 12 having a front top entrance 14. A swivel tray 16 that has a handle 18 which pivotly fits into the front top entrance 14 of the cabinet 12 with the handle 18 extending therefrom. A structure 20 is on the swivel tray 16 for holding an ashpan 22 thereon, while a mechanism 24 on the cabinet 12 is for movably closing off the front top entrance 14 after the swivel tray 16 is placed therein. A storage drawer 26 slides into the bottom of the cabinet 12 to catch all the coal ash and dust 27 dumped out of the ashpan 22 when the handle 18 is manually rotated to flip over the swivel tray 16 within the front top entrance 14.

The movably closing mechanism 24 is a door 28 hinged at 30 along its top edge to the cabinet 12. A pair of spaced apart pull rings 31 are mounted to the door 28 to be gripped, so that the door 28 can be flipped up to open. The door 28 has a U-shaped notch 32 in its bottom edge so that when the door 28 is flipped down the handle 18 on the swivel tray 16 will extend through the U-shaped notch 32.

A magnet 34 is affixed onto the top wall 36 of the cabinet 12 at the front thereof. A magnetic metal plate 38 is affixed onto the door 28 so that when the door is flipped up the plate 38 will contact the magnet 34 to hold the door 28 open allowing the swivel tray 16 with the ashpan 22 to be inserted within the front top entrance 14 of the cabinet 12. A screw 40 extends into each side edge of the door 28 while a friction catch 42 is affixed onto each side 43 of the cabinet 12. When the door 28 is flipped down the screws 40 will engage with the friction catches 42 to keep the door 28 securely closed, when the swivel tray 16 is flipped over and the ashpan 22 dumped of its coal ash and dust 27.

The holding structure 20 includes a pair of side brackets 44 spaced apart and adjustably affixed to the swivel tray 16, so that each side bracket 44 will butt up against the side of the ashpan 22. A bar 46 is adjustably affixed to each side bracket 44 to hold the ashpan 22 on the swivel tray, as best seen in FIG. 3. An extension bracket 48 having a lip 50 can be adjustably affixed to each side bracket 44, instead of the bar 46, so that the lip 50 can make contact with the top edge of the larger ashpan 22 to hold it on the swivel tray 16, as shown in FIG. 3A. A stop member 52 is connected to each side bracket 44 so that when the ashpan 22 is placed between the side brackets 44 the back wall of the ashpan will butt up against the stop members 52.

The unit 10 should be kept near a coal stove for proper use with the following directions carried out.

1. After shaking the coal stove the ashpan 22 must be removed to dispose of the coal ash and dust 27.

2. Open the door 28 of the unit 10, slide the ashpan 22 between the holding structure 20 onto the swivel tray 16 all the way back to the stop members 52 and then close the door 28.

3. Turn the handle 18 so that the swivel tray 16 will flip over dumping the coal ash and dust 27 into the storage drawer 26 below.

4. Wait a few seconds, return the handle 18 back to its original position and open the door 28, remove the ashpan 22 and replace it back in the coal stove.

LIST OF REFERENCE NUMBERS

10 internal ashpan emptying dust reducer and storage unit
12 heat resistant metal cabinet
14 front top entrance in 12
16 swivel tray
18 handle on 16
20 holding structure on 16
22 ashpan
24 movably closing mechanism
26 storage drawer
27 coal ash and dust
28 door
30 hinge
31 pull ring on 28
32 U-shaped notch in 28
34 magnet
36 top wall of 12
38 magnetic metal plate
40 screw
42 friction catch
44 side bracket
46 holding bar
48 extension bracket
50 lip on 48
52 stop member It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An internal ashpan emptying, dust reducer and storage unit comprising:

a) a heat resistant metal cabinet having a front top entrance;

b) a swivel tray having a handle, said swivel tray pivotly fits into the front top entrance of said cabinet with said handle extending therefrom;

c) means on said swivel tray for holding an ashpan thereon;

d) means on said cabinet for movably closing off the front top entrance after said swivel tray is placed therein, said movably closing means including a door hinged along its top edge to said cabinet and a pair of spaced apart pull rings mounted to said door to be gripped, so that said door can be flipped up to open, said door further having a U-shaped notch in its bottom edge so that when said door is flipped down the handle on said swivel tray will extend through the U-shaped notch;

e) a storage drawer which slides into the bottom of said cabinet to catch all the coal ash and dust dumped out of the ashpan when the handle is manually rotated to flip over said swivel tray within the front top entrance;

f) a magnet affixed onto the top wall of said cabinet at the front thereof;

g) a magnetic metal plate affixed onto the door so that when said door is flipped up said plate will contact said magnet to hold said door open allowing said swivel tray with the ashpan to be inserted within the front top entrance of said cabinet;

h) a pair of screws, each extending into one side edge of said door; and i) a pair of friction catches, each affixed onto one side of the cabinet so that when said door is flipped down said screws will engage with said friction catches to keep said door securely closed, when said swivel tray is flipped over and the ashpan dumped of its coal ash and dust.

2. The unit as recited in claim 1, wherein said holding means includes:

a) a pair of side brackets spaced apart and adjustably affixed to said swivel tray, so that each said side bracket will butt up against the side of the ashpan; and b) means on each of said side brackets for engaging with a top edge of the ashpan so as to hold the ashpan on said swivel tray.

3. The unit as recited in claim 2, further includes a pair of stop members, each connected to one said side bracket so that when the ashpan is placed between said side brackets its back wall will butt up against said stop members.

4. The unit as recited in claim 3, wherein each said engaging means is a bar adjustably affixed to said side bracket to hold the ashpan on said swivel tray.

5. The unit as recited in claim 3, wherein each said engaging means is an extension bracket having a lip adjustably affixed to said one side bracket so that the lip can make contact with one top edge of the ashpan to hold the ashpan on said swivel tray.

* * * * *